US010634375B2

(12) United States Patent
Hwang et al.

(10) Patent No.: US 10,634,375 B2
(45) Date of Patent: Apr. 28, 2020

(54) AIR CONDITIONER

(71) Applicant: LG ELECTRONICS INC., Seoul (KR)

(72) Inventors: Sungjin Hwang, Seoul (KR); Jiyoung Park, Seoul (KR); Hyungsu Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 261 days.

(21) Appl. No.: 14/984,120

(22) Filed: Dec. 30, 2015

(65) Prior Publication Data

US 2017/0191692 A1 Jul. 6, 2017
US 2018/0363931 A9 Dec. 20, 2018

(30) Foreign Application Priority Data

Jan. 2, 2015 (KR) ..... 10-2015-0000071

(51) Int. Cl.

*F24F 1/005* (2019.01)
*F24F 1/0007* (2019.01)
*F24F 1/0014* (2019.01)
*F24F 11/30* (2018.01)
*F24F 13/32* (2006.01)
(Continued)

(52) U.S. Cl.

CPC ..... *F24F 11/30* (2018.01); *F24F 1/005* (2019.02); *F24F 1/0007* (2013.01); *F24F 1/0014* (2013.01); *F24F 7/06* (2013.01); *F24F 7/065* (2013.01); *F24F 13/20* (2013.01); *F24F 13/28* (2013.01); *F24F 13/30* (2013.01);
(Continued)

(58) Field of Classification Search

CPC ..... F24F 2001/004
See application file for complete search history.

(56) References Cited

U.S. PATENT DOCUMENTS 5,753,000 A * 5/1998 Chiu ..... B01D 46/24 55/357
8,770,946 B2 * 7/2014 Fitton ..... F04F 5/16 239/265.17
2006/0199515 A1 * 9/2006 Lasko ..... F24F 7/065 454/237

FOREIGN PATENT DOCUMENTS

CN 203083028 U 7/2013
EP 2 208 943 7/2010
(Continued)

OTHER PUBLICATIONS

KR20100055204MT; machine translation of KR20100055204A.*
European Search Report dated May 18, 2016.

*Primary Examiner* — Steven B McAllister
*Assistant Examiner* — Elizabeth M. May
(74) *Attorney, Agent, or Firm* — Ked & Associates, LLP

(57) ABSTRACT

An air conditioner is provided that may include a pair of air discharge devices; an air discharge device holder that supports the pair of air discharge devices to be spaced apart from each other; and a display positioned between the pair of air discharge devices and having a first side surface that faces an outer peripheral surface of a first air discharge device of the pair of air discharge devices and a second side surface that faces an outer peripheral surface of a second air discharge device of the pair of air discharge devices. The display may be positioned between the pair of air discharge devices, allowing the air conditioner to be compact while preventing any safety accident which might occur if a space between the pair of air discharge devices were exposed to the outside.

14 Claims, 8 Drawing Sheets

(51) Int. Cl.

| | |
|---|---|
| ***F24F 7/06*** | (2006.01) |
| ***F24F 13/28*** | (2006.01) |
| ***F24F 13/30*** | (2006.01) |
| ***F24F 13/20*** | (2006.01) |
| ***F24F 11/52*** | (2018.01) |

(52) U.S. Cl.
CPC ..... *F24F 13/32* (2013.01); *F24F 11/52* (2018.01); *F24F 2221/02* (2013.01)

(56) References Cited

FOREIGN PATENT DOCUMENTS

| | | | | |
|---|---|---|---|---|
| JP | 2013-220399 | | | 10/2013 |
| KR | 20-1999-002705 | | | 1/1999 |
| KR | 10-0183553 | | | 5/1999 |
| KR | 20-2009-0001591 | | | 2/2009 |
| KR | 20100055204 | A | * | 5/2010 |
| KR | 10-2011-0038403 | | | 4/2011 |
| KR | 10-1385290 | | | 4/2014 |

* cited by examiner

AIR CONDITIONER

CROSS-REFERENCE TO RELATED APPLICATION

This application claims priority under 35 U.S.C. § 119 to Korean Application No. 10-2015-0000071, filed in Korea on Jan. 2, 2015, whose entire disclosure is hereby incorporated by reference.

BACKGROUND

1. Field

An air conditioner is disclosed herein.

2. Background

Air conditioners are appliances that suction in air, change a temperature, moisture, or cleanness of the air, and then discharge the air to the outside. An air conditioner may include a cooler or heater that changes an indoor temperature, a humidifier or dehumidifier that changes an indoor humidity, and an air purifier that changes indoor air cleanness.

An air conditioner may include air conditioning unit or device that changes the temperature humidity, or cleanness of the air, and a blower that blows the air into the air conditioning device. The air conditioning device may be a heat exchanger or a filter, for example.

An air conditioner may have an air discharge body, such as a header or a diffuser. The air may be changed in at least one of its temperature, humidity, or cleanness inside of the air conditioner and may be then discharged via the air discharge body to the outside. The air discharge body may be elevatably or rotatably installed in the air conditioner.

BRIEF DESCRIPTION OF THE DRAWINGS

Embodiments will be described in detail with reference to the following drawings in which like reference numerals refer to like elements, and wherein.

DETAILED DESCRIPTION

Figure 1:
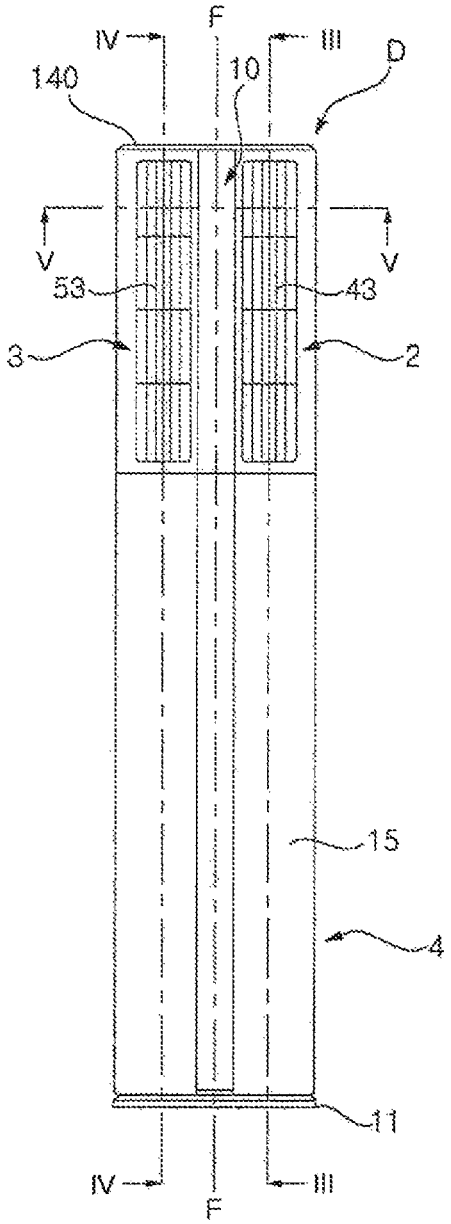
FIG. 1 is a front view of an air conditioner according to an embodiment.
Figure 2:
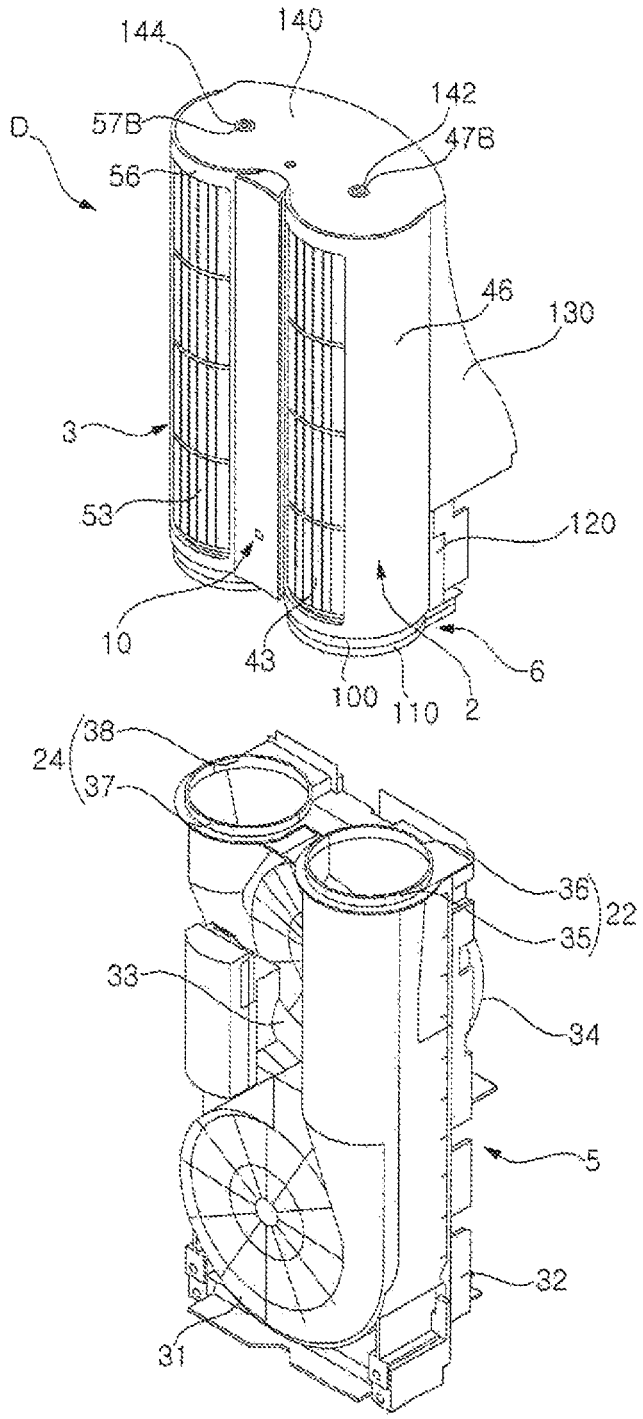
FIG. 2 is a perspective view illustrating an example in which an air discharge device and a blower of an air conditioner are separated from each other, according to an embodiment.
Figure 3:
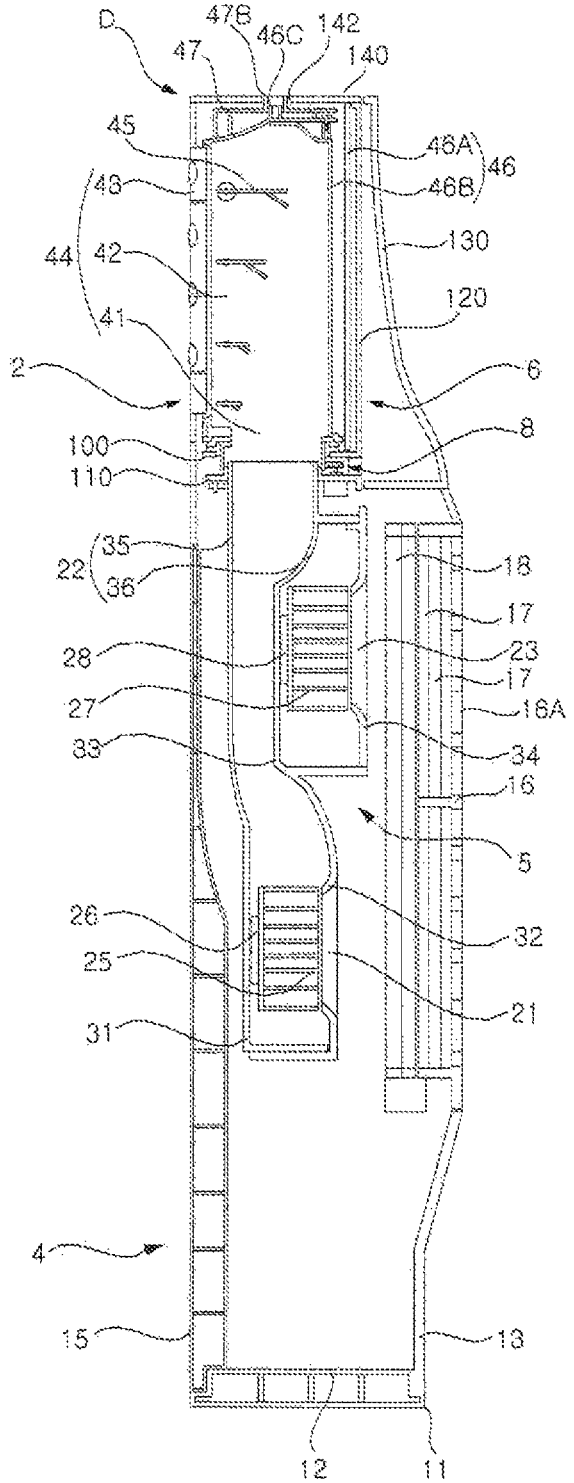
FIG. 3 is a cross-sectional view taken along line III-III of FIG. 1.
Figure 4:
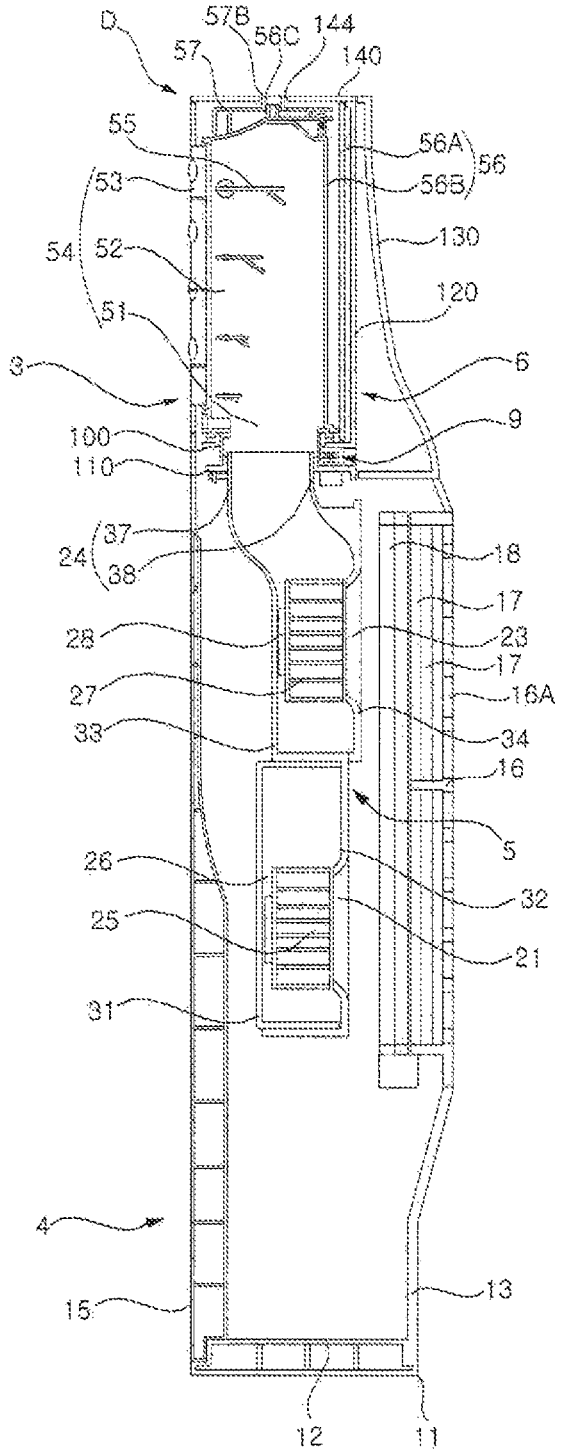
FIG. 4 is a cross-sectional view taken along line IV-IV of FIG. 1.
Figure 5:
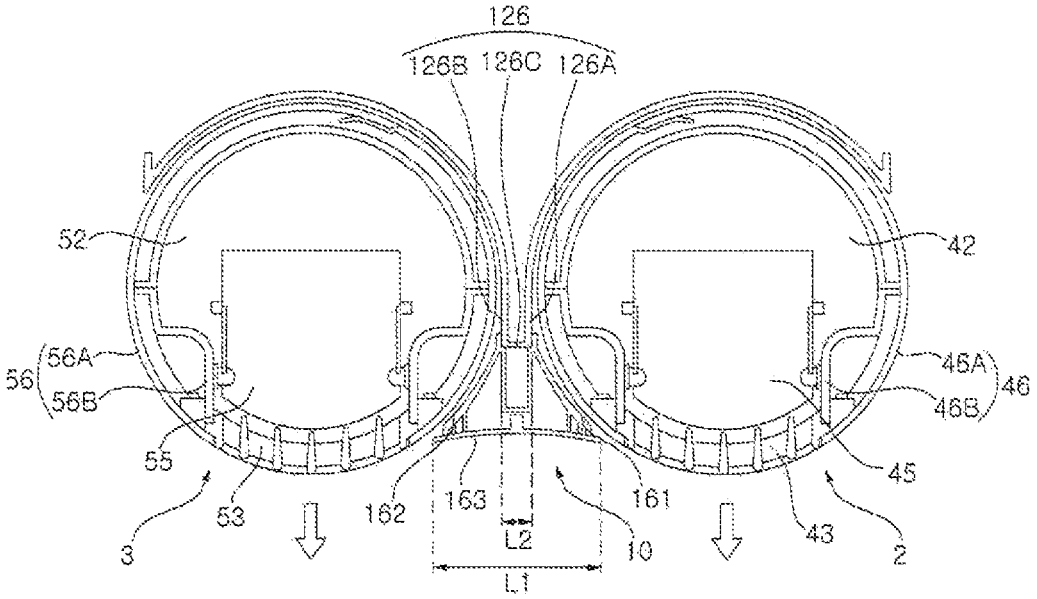
FIG. 5 is a cross-sectional view taken along line V-V of FIG. 1.
Figure 6:
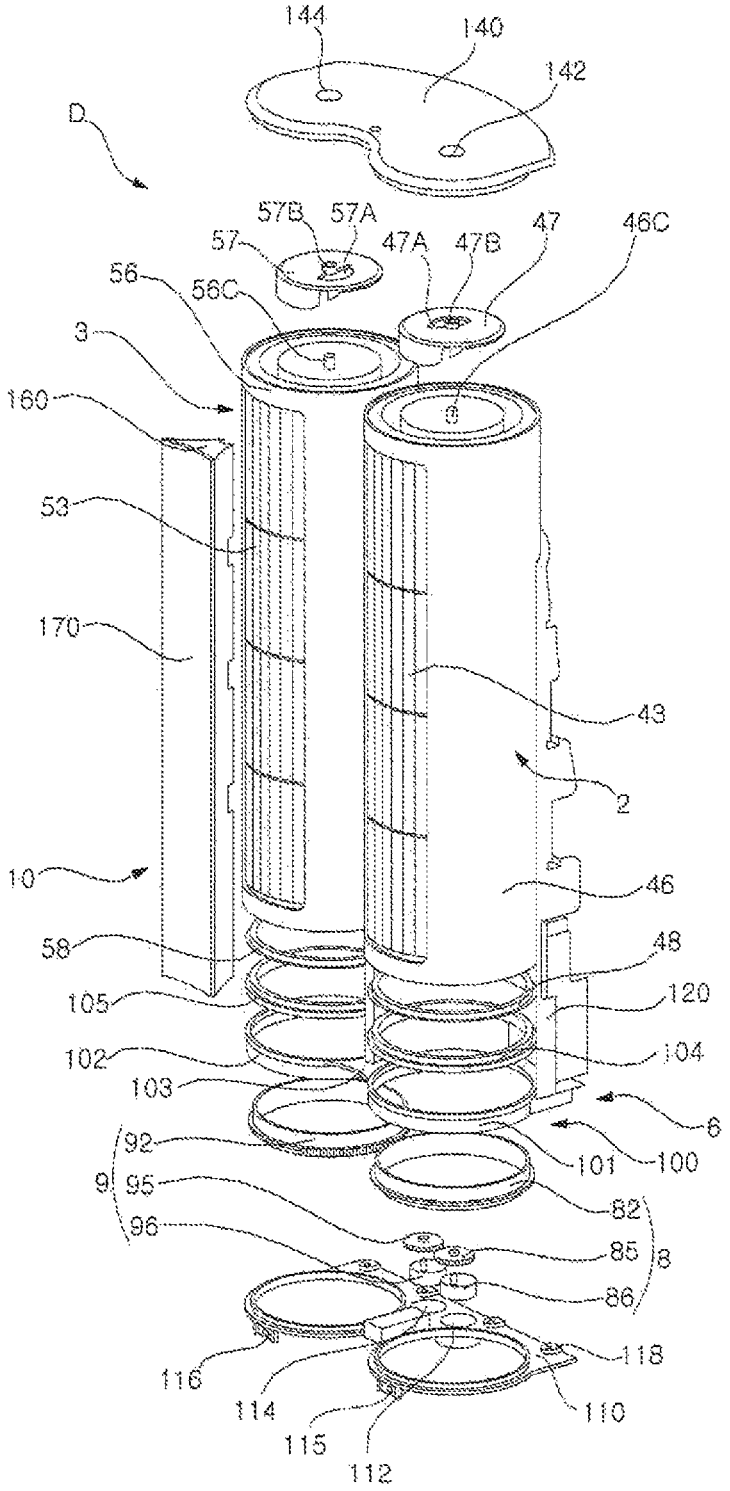
FIG. 6 is an exploded perspective view illustrating an air discharge device and an air discharge device holder of an air conditioner according to an embodiment.

FIG. 1 is a front view of an air conditioner according to an embodiment. FIG. 2 is a perspective view illustrating an example in which, an air discharge device and a blower of an air conditioner are separated from each other, according to an embodiment. FIG. 3 is a cross-sectional view taken along line III-III of FIG. 1. FIG. 4 is a cross-sectional view taken along line IV-IV of FIG. 1. FIG. 5 is a cross-sectional view taken along line V-V of FIG. 1. FIG. 6 is an exploded perspective view illustrating an air discharge device and an air discharge device holder of an air conditioner according to an embodiment.

The air conditioner may include a pair of air discharge units or devices 2 and 3, an air discharge device holder 6 that supports the pair of air discharge devices 2 and 3 to space them apart from each other, and a display 10 positioned between the pair of air discharge devices 2 and 3.

The pair of air discharge devices 2 and 3 may be provided spaced apart from each over in a horizontal direction by the air discharge device holder 6, and the display 10 may extend lengthwise in a vertical direction between the pair of air discharge devices 2 and 3. The display 10 may block a gap between the pair of air discharge devices 2 and 3 so that the gap is not viewable from a front of the air conditioner.

The pair of air discharge devices 2 and 3, the air discharge device holder 6, and the display 10 may form an air discharge assembly D that discharges the air air-conditioned by the air conditioner to the outside. The air discharge assembly D may be installed in an air purifier having a blower 5 and a purifying unit or device 17, and the air purified by the purifying device 17 may be distributively discharged to the outside through the pair of air discharge devices 2 and 3. In this case, the air conditioner may be an air purifier that purifies indoor air. The purifying device 17 may be, for example, a filter that filters foreign materials out of air, an electric dust collector that collects dust or other foreign materials by electrification, a water screen filter that collects foreign materials and absorbs moisture from air passing therethrough, or an ion generator that generates ions in the air.

The air discharge assembly D may be installed in a cooler, a heater or a dehumidifier having the blower 5 and a heat exchanger 18, and air heat-exchanged with the heat exchanger 18 may be distributively discharged through the pair of air discharge devices 2 and 3 to the outside. In this case, the air conditioner may be a cooler, a heater, or a dehumidifier that varies an indoor temperature or moisture.

The air conditioner may include a body (not shown), the air discharge assembly D, and a connecting duct (not shown) that connects the body with the air discharge assembly D, and at least one of the heat exchanger 18, the purifying device 17, or the blower 5 may be installed in the body. In this case, the air discharge assembly D may be installed, spaced apart from the body, and the air supplied from the body through the connecting duct may flow to the pair of air discharge devices 2 and 3 and may then be discharged outside of the pair of air discharge devices 2 and 3.

The pair of air discharge devices 2 and 3 may guide the air blown by the blower 5 to the outside. The pair of air discharge devices 2 and 3 may distributively discharge the air coming from the blower 5 to the outside, with the air discharge devices 2 and 3 provided in parallel with each other by the air discharge device holder 6.

The pair of air discharge devices 2 and 3 may have a same structure and different positions. Each of the pair of air discharge devices 2 and 3 may have an air inlet, through which air may be introduced, an air outlet, through which air may be discharged, and an internal flow path therein, which may guide the air introduced through the air inlet to the aft outlet. The air outlet may be provided at a portion of a periphery among an upper portion, a lower portion, and a periphery thereof. The air inlet may be provided at one of the upper portion, the lower portion, or the periphery thereof.

In a case in which the air inlet is formed at the lower portion of each of the pair of air discharge devices 2 and 3, the air blown by the blower 5 may be introduced through the lower portion of the pair of air discharge devices 2 and 3 into the internal flow path and may be discharged to the outside through the air outlet formed at the portion of the periphery of each of the pair of air discharge devices 2 and 3. In a case in which the air inlet is formed at the upper portion of each of the pair of air discharge devices 2 and 3, the air blown by the blower 5 may be introduced through the upper portion of the pair of air discharge devices 2 and 3 into the internal flow path and may be discharged to the outside through the air outlet formed at the portion of the periphery of each of the pair of air discharge devices 2 and 3.

In a case in which the air inlet is formed at the periphery of each of the pair of air discharge devices 2 and 3, the air inlet may be formed at a portion of the periphery which is spaced apart from the air outlet. In this case, the pair of air discharge devices 2 and 3 may be shaped so that their top and bottom surfaces are closed. The air blown by the blower 5 may be introduced through the air inlet formed at the periphery of each of the pair of air discharge devices 2 and 3 into the internal flow path and may be discharged to the outside through the air outlet formed at the periphery of each of the pair of air discharge devices 2 and 3.

One of the pair of air discharge devices 2 and 3 may be a first or left air discharge device 2 positioned at a first or left side of a central line F of the air conditioner, and the other of the pair of air discharge devices 2 and 3 may be a second or right air discharge device 3 positioned at a second or right side of the central line F of the air conditioner. The first air discharge device 2 may discharge air from the first side of the air conditioner to a front side of the air conditioner, and the second air discharge device 3 may discharge air from the second side of the air conditioner to the front side of the conditioner.

The first air discharge device 2 and the second air discharge device 3 may discharge air in opposite directions thereof. The first air discharge device 2 may discharge air in a first or leftward direction of the air conditioner, and the second air discharge device 3 may discharge air in a second or rightward direction of the air conditioner.

The first air discharge device 2 may discharge air in a first inclined direction, which may be a leftward and frontward direction of the air conditioner, and the second air discharge device 3 may discharge air in a second inclined direction, which may be a rightward and frontward direction of the air conditioner. Further, the first air discharge device 2 may discharge air in a frontward direction of the air conditioner, and the second air discharge device 3 may discharge air in the frontward direction of the air conditioner. In this case, the first air discharge device 2 and the second air discharge device 3 may discharge air in parallel directions, and two front air flows may be created at a front of the air conditioner.

The air conditioner may further include a casing 4 that forms an outer appearance thereof, and the blower 5 that blows air to the pair of air discharge devices 2 and 3.

The air conditioner may be a stand-alone air conditioner installed on a floor of a room or as a wall-mounted air conditioner hung and installed onto a wall.

Hereinafter, a stand-alone air conditioner is described as an example.

The casing 4 may include a base 11. The base 11 may have a stereoscopic shape with open front and top surfaces. The base 11 may include a lower frame 12 and a rear plate 13 formed on the lower frame 12. The rear plate 13 may extend vertically from a rear portion of the lower frame 12.

The casing 4 may further include a front cover 15. The front cover 15 may be provided to cover a front side of the blower 5. A bottom of the front cover 15 may be mounted on the lower frame 12 of the base 11. The front cover 15 may be provided at the lower frame 12 to shield a portion of the lower frame 12.

The casing 4 may include a suction inlet 16, through which air may be suctioned into an inside of the air conditioner. The suction inlet 16 may be provided at a top of the base 11. The suction inlet 16 may be provided at a top of the rear plate 13 of the base 11. The suction inlet 16 may be provided to extend lengthwise in a vertical direction at the top of the rear plate 13 of the base 11. The suction inlet 16 may include an air let 16A, through which air may be suctioned from outside of the air conditioner into the inside of the air conditioner.

The air conditioner may include the purifying device 17 that purifies air. The purifying device 17 may be installed in the suction inlet 16 and air introduced into the air conditioner may be purified by the purifying device 17. The purifying device 17 may include at least one of a filter that filters foreign materials out of air passing therethrough, an electric dust collector that collects dust from the air by electrification, and an ion generator that generates ions in the air.

The air conditioner may include the heat exchanger 18 provided inside of the casing 4 to exchange heat between the air and a coolant. The heat exchanger 18 may be positioned between the suction inlet 16 and the blower 5 in an air flow direction.

The blower 5 may be installed inside of the casing 4. The blower 5 may be installed opposite a portion of the heat exchanger 18. The blower 5 may be positioned at a front side of the heat exchanger 18. The blower 5 may suction in air from a rear side thereof and blow the air in an upward or downward direction.

The blower 5 may include a first air discharge device 22 that blows air to an inside of the first air discharge device 2 and a second air discharge 24 that blows the air to an inside of the second air discharge device 3. The blower 5 may distributively discharge the air suctioned in through a suction inlet to the first air discharge 22 and the second air discharge 24. The blower 5 may include a plurality of suction inlets 21 and 23. In a case in which the blower 5 includes the plurality of suction inlets 21 and 23, the air suctioned in through a first suction inlet 21 of the plurality of suction inlets 21 and 23 may be blown to the first air discharge 22, and the air suctioned in through a second suction, inlet 23 of the plurality of suction inlets 21 and 23 may be blown to the second air discharge 24. In the case of having the plurality of suction inlets 21 and 23, the blower 5 may include a first air flow path, through which the air suctioned in through the first suction inlet 21 may be discharged to the second air discharge 22 and a second air flow path, through which the air suctioned in through the second suction inlet 23 may be discharged to the second air discharge 24. In the case of having the plurality of suction inlets 21 and 23, the blower 5 may include a first blower 25 rotated in the first air flow path, and a first fan motor 26 that rotates the first blower 25, and a second blower 27 rotated in the second air flow path, and a second fan motor 28 that rotates the second blower 27.

The blower 5 may include a first fan housing 31 having the first fan motor 26 mounted therein and surrounding the first blower 25, and a first orifice 32 coupled with the first fan housing 31 and having the first suction inlet 21 that guides air to the first blower 25. The blower 5 may include a second fan housing 33 having the second fan motor 28 mounted wherein, and surrounding the second blower 27, and a second orifice 34 coupled with the second fan housing 33 and having the second suction inlet 23 that guides air to the second blower 27.

The second fan housing 33 may be formed at an upper side of the first orifice 32 and integrally with the first orifice 32. The second orifice 34 may be coupled with the second fan housing 33 at a rear side of the second fan housing 33, and the first fan housing 31 may be coupled with the first orifice 32 at a front side of the first orifice 32.

The blower 5 may be positioned under the air discharge assembly D to blow air to the air discharge assembly D. The blower 5 may be positioned above the air discharge assembly D to blow air to the air discharge assembly D. The blower 5 may be positioned behind the air discharge assembly D to blow air to the air discharge assembly D. In a case in which the blower 5 is positioned under the air discharge assembly D, the first air discharge 22 and the second air discharge 24, each, may be positioned at an upper portion of the blower 5, and each may discharge and guide air in an upward direction.

The first air discharge 22 may be formed by the first fan housing 31 and the second fan housing 33, as shown in FIG. 3. The first fan housing 31 may include a first front duct 35 with open rear and top surfaces, which may project in an upward direction and be provided at a front side of a portion of the second fan housing 33. The second fan housing 33 may include a first rear duct 36, which may be positioned at a rear side of the first front duct 35. The first rear duct 36 may have open front and top surfaces and may be shaped to be recessed in a rearward direction in the second fan 33. The first front duct 35 and the first rear duct 36 may guide the air blown by the first blower 25 to the first air discharge device 2. When the first fan housing 31 and the second fan housing 33 are coupled with each other so that the first front duct 35 is positioned at a front side of the first rear duct 36, the first front duct 35 and the first rear duct 36 may form a duct unit or device shaped as a hollow cylinder.

The second air discharge 24 may be formed by the second fan housing 33 and the second orifice 34, as shown in FIG. 4. The second fan housing 31 may have the second front duct 37 with open rear and top surfaces, which may project it a frontward direction and be positioned at a front side of a portion of the second orifice 34. The second orifice 34 may include a second rear duct 38, which may be positioned at a rear side of the second front duct 37. The second inner guide 38 may have open front and top surfaces. The second front duct 37 and the second rear duct 38 may guide the air blown by the second blower 27 to the second air discharge device 3. When the second fan housing 33 and the second orifice 34 are coupled with each other so that the second front duct 37 is positioned at a front side of the second rear duct 38, the second front duct 37 and the second rear duct 38 may form a duct unit or device shaped, as a hollow cylinder.

Hereinafter, an example in which an air inlet is formed at a lower portion of each of the pair of air discharge devices 2 and 3 and an air outlet at a portion of a periphery thereof is described.

The air discharge device 2, one may include a first air inlet 41, through which the air blown by the blower 5 may be introduced, a first internal flow path 42 that guides air having passed through the first air inlet 41, and a first air outlet 43, through which air guided by the first internal flow path 42 may be discharged to the outside. The first air inlet 41, the first internal flow path 42, and the first air outlet 43 may form a first air discharge flow path 44 of the first air discharge device 2.

A first wind direction adjusting vane 45 may be provided in the first air discharge device 2 to adjust a direction of air passing through the first air discharge flow path 44. The first wind direction adjusting vane 45 may be rotatably provided inside of the first air discharge device 2. The first wind direction adjusting vane 45 may be positioned at or in the first internal flow path 42, with a tip thereof facing the first air outlet 43.

The first air inlet 41 may be formed at a lower portion of the first air discharge device 2 to pass therethrough in a vertical direction. The internal flow path 42 may extend lengthwise in a vertical direction inside of the first air discharge device. The first air outlet 43 may be formed on a periphery of the first air discharge device 2. The first air discharge device 2 may be shaped so that a top surface thereof is closed, and the first air outlet 43 may be formed at the periphery among the top plate and the periphery of the first air discharge device 2. The first air outlet 43 may be formed on the periphery of the first air discharge device 2 to penetrate the same in a horizontal direction. The first air outlet 43 may be extend lengthwise in a vertical direction on the periphery of the first air discharge device 2. The opened direction of the first air inlet 41 may be perpendicular with the opened direction of the first air outlet 43. After flowing through the first air inlet 41 to the inside of the first air discharge device 2, the air may change in flow direction, and may be discharged through the first air outlet 43 in a horizontal direction.

The first air discharge device 2 may be formed of an assembly of a plurality of members. The first air discharge device 2 may include a first air discharge body 46 having the first air discharge flow path 44, a first top body 47 provided at an upper side of the first air discharge body 46, and a first lower ring 48 coupled with a lower portion of the first air discharge body 46.

The first air discharge body 46 may be shaped as a cylinder with a closed top surface and an open bottom surface. The first air inlet 41, the first internal flow path 42, and the first air outlet 43, as shown in FIG. 3, may be formed in the first air discharge body 46, and the first airy outlet 43 may be formed at a portion of an outer circumferential portion of the first air discharge body 46.

The first wind direction adjusting vane 45, as shown in FIG. 3, may be rotatably provided in the first air discharge body 46. The first air discharge body 46 may include a first wind direction adjuster motor (not shown) that generates a dynamic force to rotate the first wind direction adjusting vane 45. The first wind direction adjusting motor may be connected with the first wind direction adjusting vane 45 directly or via a dynamic force transferring member, such as a link.

The first air discharge bad y 46 may be formed of an assembly of a plurality of members. The first air discharge body 46 may include a first outer body 46A that forms an outer appearance of the first air discharge body 46, and a first inner guide 46B provided inside of the first outer body 46A. The first air discharge body 46 may have a first rotational protrusion 46C that projects to form a rotational center axis of the first air discharge device 2.

The first outer body 46A may be shaped as a hollow cylinder. The first outer body 46A may be open at its top and bottom and may have a space therein to accommodate the first inner guide 46B. The first outer body 46A may be formed so that a plurality of outer bodies, each having an arc-shaped cross section, may be coupled into a hollow cylinder shape, and one of the plurality of outer bodies may include the first air outlet 43 at which a first air discharge grill may be formed.

The first inner guide 46B may be shaped as a hollow bucket with an open bottom surface and a closed top surface. The first air inlet 41 may be formed at a lower portion of the first inner guide 46B, and the first internal flow path 42 may be formed inside of the first inner guide 46B. The first wind direction adjusting vane 45 may be rotatably connected with the first inner guide 46B.

The first top body 47 may be an electric wire guide that guides a first electric wire (not shown) connected to the first wind direction adjusting motor (not shown). Thus, the first top body 47 may have an electric wire through hole 47A, through which the first electric wire may pass. The first top body 47 may be press fitted into an upper portion of the first air discharge body 46 or may be mounted to the upper portion of the first air discharge body 46 by, for example, a screw or other connecting members.

The first top body 47 may have a first boss 47B that projects in an upward direction to surround the first rotational protrusion 46C. The first boss 478, together with the first rotational protrusion 46C, may form a rotational center axis of the first air discharge device 2. The first boss 47B may be positioned between the first rotational protrusion 46C and a first axis support 142 of top cover 140 and may be supported by the axis support 142. In other words, the first air discharge device 2 may be rotatably maintained in position at the top cover 140 by the first rotational protrusion 46C and the first boss 47B.

The first lower ring 48 may be coupled with a lower portion of the first air discharge body 46 and may be rotated along with the first air discharge body 46. The first lower ring 48 may be coupled with the first air discharge body 46 by, for example, a screw or other connecting members. The first lower ring 48 may have a connecting member through hole, through which a screw or other connecting member may pass, for example.

The first lower ring 48 may be seated in the lower body 100 and may rub against the lower body 100. The first lower ring 48 may be formed of metal to reinforce a strength of the first air discharge body 46 while preventing the first air discharge body 46 from being worn.

The second air discharge device 3 may include a second air inlet 51, through which air blown by the blower 5 may be introduced, a second internal flow path 52 that guides the air having passed through the second air inlet 51, and a second air outlet 53, through which air guided by the second internal flow path 52 may be discharged to the outside. The second air inlet 51, the second internal flow path 52, and the second air outlet 53 may form the second air discharge flow path 54 of the second air discharge device 3.

A second wind direction adjusting vane 55 may be provided in the second air discharge device 3 to adjust a direction of air passing through the second air discharge flow path 54. The second wind direction adjusting vane 55 may be rotatably provided inside of the second air discharge device 3. The second wind direction adjusting vane 55 may be positioned at or in the second internal flow path 52, with a tip thereof facing the second air outlet 53.

The second air inlet 51 may be formed at a lower portion of the second air discharge device 3 to penetrate the same in a vertical direction. The second internal flow path 52 may extend lengthwise in a vertical direction inside of the second air discharge device 3. The second air outlet 53 may be formed on a periphery of the second air discharge device 3. The second air discharge device 3 may be shaped so that a top surface thereof is closed, and the second air outlet 53 may be formed at a periphery among the top plate and the periphery of the second air discharge device 3. The second air outlet 53 may be formed on the periphery of the second air discharge device 3 to penetrate the same in a horizontal direction. The second air outlet 53 may be formed at the periphery of the second air discharge device 3 to penetrate the same in a vertical direction. The opened direction of the second air inlet 51 may be perpendicular with the opened direction of the second air outlet 53. After flowing through the second air inlet 51 to the inside of the second air discharge device 3, the air may change in flow direction, and may be discharged through the second air outlet 53 in a horizontal direction.

The second air discharge device 3 may be formed of an assembly of a plurality of members. The second air discharge device 3 may include a second air discharge body 56 having a second air discharge flow path 54, a second top body 57 provided at an upper side of the second air discharge body 56, and a second lower ring 58 coupled with a lower portion of the second air discharge body 56.

Like the first air discharge body 46, the second air discharge body 56 may be shaped as a cylinder with a closed top surface and an open bottom surface. The second air inlet 51, the second internal flow path 52, and the second air outlet 53, as shown in FIG. 3, may be formed in the second air discharge body 56, and the second air outlet 53 may be formed at a portion of an outer circumferential portion of the second air discharge body 56.

The second wind direction adjusting vane 55 may be rotatably provided in the second air discharge body 56. The second air discharge body 56 may include a second wind direction adjuster motor (not shown) that generates a dynamic force to route the second wind direction adjusting vane 55. The second wind direction adjuster motor may be connected with the second wind direction adjusting vane 55 directly or via a dynamic force transferring member, such as a link.

The second air discharge body 56 may be formed of an assembly of a plurality of members. The second air discharge body 58 may include a second outer body 56A that forms an outer appearance of the second air discharge body 56, and a second inner guide 56A provided inside of the second outer body 56B. The second air discharge body 56 may have a second rotational protrusion 56C that projects to form a rotational center axis of the second air discharge device 3.

The second outer body 56A may have an overall shape of a hollow cylinder. The second outer body 56A may be open it its top and bottom and may have a space therein to accommodate the second inner guide 56B. The second outer body 56A may be formed so that a plurality of outer bodies, each having, an arc-shaped cross section, may be coupled into a hollow cylinder shape, and one of the plurality of outer bodies may have the second air outlet 53 in which a second air discharge grill may be formed.

The second inner guide 56B may be shaped as a hollow bucket with an open bottom surface and a closed top surface. The second air inlet 51 may be formed at a lower portion of the second inner guide 56B, and the second internal flow path 52 may be formed inside of the second inner guide 56B. The second wind direction adjusting vane 55 may be rotatably connected with the second inner guide 568.

The second top body 57 may be an electric wire guide that guides a second electric wire (not shown) connected to the second wind direction adjusting motor (not shown). Thus, the second top body 57 may have an electric wire through hole 57A, through which the second electric wire may pass. The second top body 57 may be press fitted into an upper portion of the second air discharge body 56 or may be mounted to the upper portion of the second air discharge body 56 by, for example, a screw or other connecting members.

The second top body 57 may have a second boss 57B that projects in an upward direction to surround the second rotational protrusion 56C. The second boss 57B, together with the second rotational protrusion 56C, may form a rotational center axis of the second air discharge device 3. The second boss 578 may be positioned between the second rotational protrusion 56C and second support 144 of the top cover 140 and may be supported by the second support 144. In other words, the second air discharge device 3 may be rotatably maintained in position at the top cover 140 by the second rotational protrusion 46C and the second boss 57B.

The second lower ring 58 may be coupled with a lower portion of the second air discharge body 56 and may be rotated along with the second air discharge body 56. The second lower ring 58 may be coupled with the second air discharge body 56 by, for example, a screw or other connecting members. The second lower ring 58 may have a connecting member through hole, through which a screw or other connecting member may pass, for example.

The second lower ring 58 may be seated in the lower body 100 and may rub against the lower body 100. The second lower ring 58 may be formed of metal to reinforce a strength of the second air discharge body 56 while preventing the second air discharge body 56 from being worn.

The air discharge device holder 6 may include the lower body 100, in which the second air discharge device 3 may be mounted. At least a portion of the air discharge device holder 6 may include a rear body 120 positioned behind the pair of air discharge devices 2 and 3. The air discharge device holder 6 may include top cover 140 positioned at an upper side of the pair of air discharge devices 2 and 3.

The rear body 120 may be provided at a lower portion of the top cover 140, and the overall air discharge device holder 6 may be shaped as an overturned "L." The rear body 120 may be provided at an upper portion of the lower body 100, and the overall air discharge device holder 6 may be shaped as the letter "L." The top cover 140 and the lower body 100 may be spaced apart from each other in a vertical lower direction, and the rear body 120 may be provided between the top cover 140 and the lower body 100, and thus, the overall air discharge device holder 6 may be shaped as a lying "U."

The lower body 100 may rotatably support the lower portion of each of the pair of air discharge devices 2 and 3. The pair of air discharge devices 2 and 3 may be seated on the lower body 100, spaced apart from the lower body 100, and a load of the pair of air discharge devices 2 and 3 may be distributed on the lower body 100. The lower body 100 may form a lower portion of the air discharge device holder 6.

The lower body 100 may include a ring-shaped first seat 101, a ring-shaped second seat 102, and a lower plate 103 that connects the first seat 101 with the second seat 102. The first air discharge device 2 may be rotatably seated on the first seat 101, and it may be rotatably seated on a first fixing ring 104, which is described hereinbelow. The second air discharge device 3 may be rotatably seated on the second seat 102, and it may be rotatably seated on a second fixing ring 105, which is described hereinbelow.

The lower plate 103 may be integrally formed with the first seat 101 and the second seat 102. The lower plate 103 may be positioned between the first seat 101 and the second seat 102, at a rear side of the first seat 101, and at a rear side of the second seat 102.

The lower body 100 may be formed of an assembly of a plurality of members, and may further include the first fixing ring 104, which may be installed in the first seat 101, and in which the first air discharge device 2 may be rotatably seated and the second fixing ring 105, which may be installed in the second seat 102 and in which the second air discharge device 3 may be rotatably seated.

The first fixing ring 104 and the first lower ring 48 may be formed of metal. Further, the first lower ring 48 may be seated on the first fixing ring 104.

The second fixing ring 105 and the second lower ring 48 may be formed of metal. Further, the second lower ring 58 may be seated on the second fixing ring 105.

The air discharge device holder 6 may further include a lower cover 110 installed in the lower body 100. The lower cover 110 may be coupled to a lower portion of the lower body 100. The lower cover 110 may be coupled to an upper portion of the blower 5. The lower cover 110 may function as an air discharge device holder mounter that mounts the air discharge device holder 6 to the blower 5.

The air conditioner may include an air discharge device rotating mechanism that rotates the pair of air discharge devices 2 and 3. The air discharge device rotating mechanism may include a first air discharge device rotating mechanism 8 that rotates the first air discharge device 2 and a second air discharge device rotating mechanism 9 that rotates the second air discharge device 3.

The first air discharge device rotating mechanism 8 may include a first gear 82 provided in the first air discharge device 2, a first drive gear 85 engaged with the first gear 82 to rotate the first gear 82, and a first motor 86 that rotates the first drive gear 85. The first gear 82 may be a first slave gear, which may be rotated by the first drive gear 85. The first gear 82 may have a ring-shaped body. The ring-shaped body may have, on its outer periphery, gear teeth engaged with the first drive gear 85. The ring-shaped body may be coupled with at least one of the first lower ring 48 or the first air discharge body 46 of the first air discharge device 2 by, for example, a screw or other connecting member. The ring-shaped body may have a connecting member through hole, through which a screw or other connecting member may pass, for example.

The first drive gear 85 may be formed to be smaller in size than a size of the first gear 82. The first drive gear 85 may be positioned adjacent to the first gear 82, and the first drive gear 85 may rotate the first gear 82 at a position adjacent to the first gear 82. The first motor 86 may be installed in the lower cover 110.

The second air discharge device rotating mechanism 9 may include a second gear 92 provided in the second air discharge device 3, a second drive gear 95 engaged with the second gear 92 to rotate the second gear 92, and a second motor 96 that rotates the second drive gear 95.

The second gear 92 may be a second slave gear, which may be rotated by the second drive gear 95. The second gear 92 may have a ring-shaped body. The ring-shaped body may have, on its outer periphery, gear teeth engaged with the second drive gear 95. The ring-shaped body may be coupled with at least one of the second lower ring 58 or the second air discharge body 56 of the second air discharge device 3 by, for example, a screw or other connecting member. The ring-shaped body may have a connecting member through hole, through which a screw or other connecting member may pass, for example.

The second drive gear 95 may be formed to be smaller in size than the second gear 92. The second drive gear 95 may be positioned adjacent to the second gear 92, and the second drive gear 95 may rotate the second gear 92 at a position adjacent to the second gear 92. The second motor 96 may be installed in the lower cover 110.

The lower cover 110 may have a first motor accommodating part or portion 112 in which the first motor 86 may be inserted and accommodated, and a second motor accommodating part or portion 114 in which the second motor 96 may be inserted and accommodated. The lower cover 110 may include a plurality of couplers 115 and 116 coupled with the blower 5 by, for example, a screw or other connecting member. The lower cover 110 may have at least one lower body coupler 118 coupled to the lower body 100 by, for example, a screw or other connecting member.

The rear body 120 may extend perpendicular to the lower body 100 and may accommodate at least a portion of each of the pair of air discharge devices 2 and 3. The rear body 120 may rotatably accommodate the pair of air discharge devices 2 and 3. The rear body 120 may be integrally formed with the lower body 100 at a rear side of the lower body 100. The rear body 120 may be formed separately from the lower body 100 and may be coupled with a rear portion of the lower body by, for example, a connecting member such as screws or hooks. The rear body 120 may be formed to be larger in size than the gap between the pair of air discharge devices 2 and 3. The rear body 120 may shield the gap between the pair of air discharge devices 2 and 3 at a rear side of the pair of air discharge devices 2 and 3.

The rear body 120 may have a protrusion 126 that projects toward the gap between the pair of air discharge devices 2 and 3. The protrusion 126 may include a first side 126A that faces the first air discharge device 2, and a second side 126B that faces the second air discharge device 3. The protrusion 126 may further include a front plate 126C that connects an end of the first side 126A with an end of the second side 126B. The protrusion 126 may be shaped so that lateral or left and right side surfaces thereof and a rear surface thereof are open.

The air conditioner may further include a back cover 130 coupled to the rear body 120. The back cover 130 may cover a back surface of the rear body 120 to protect the rear body 120. The back cover 130 may be positioned at an upper side of the suction inlet 16 to cover an upper side of the suction inlet 16.

The top cover 140 may cover the gap between the pair of air discharge devices 2 and 3 at an upper side of the pair of air discharge devices 2 and 3. The top cover 140 may cover the gap between an upper portion of the display 10 and an upper portion of the protrusion 126.

The top cover 140 may be coupled to the rear body 120. The top cover 140 may maintain an upper portion of the pair of air discharge devices 2 and 3 in position. The top cover 140 may have first support 142 that rotatably supports an upper portion of the first air discharge device 2 and a second support 144 that rotatably supports an upper portion of the second, air discharge device 3. The first support 142 may be a supporting hole that rotatably supports the rotational center axis of the first air discharge device 2. The second support 144 may be a support hole that rotatably supports the rotational center axis of the second air discharge device 3. The top cover 140 may be connected to an upper portion of the rear body 120 by, for example, a connecting member such as a screw, or a hooking member such as a hook.

A first side surface 161 of the display 10 may face an outer periphery of the first air discharge device 2, and a second side surface 162 of the display 10 may face an outer periphery of the second air discharge device 3. A front surface 163 of the display 10 may be exposed to the outside.

The display 10 may be formed of an assembly of a plurality of members. The display 10 may function as a control panel for manipulation of the air conditioner and as a display to display information on the air conditioner. The display 10 may function as a display-cum-control panel.

The display 10 may be smaller in size than each of the pair of air discharge devices 2 and 3. A lateral or left-right width of the display 10 may increase in a forward direction. A lateral or left-right width L1 of a tip of the display 10 may be larger than a lateral or left-right width L2 of a tip of the protrusion 126.

The display 10 may be provided at an upper side of the lower body 100. The display 10 may be positioned at an upper side of the lower plate 103 of the lower body 100. A portion of the display 10 may be positioned at a lower side of the top cover 140, and the display 10 may shield the gap between the pair of air discharge devices 2 and 3 between the lower body 100 and the top cover 140. The display 10 may partition to the left and right a space between the lower body 100 and the top cover 140.

The air discharge device holder 6 may be shaped so that a first or left side surface and a front surface thereof are each open. The air discharge device holder 6 may play a role as a frame that maintains the pair of air discharge devices 2 and 3 in parallel with each other, and the pair of air discharge devices 2 and 3 may be positioned to the left and right about the air discharge device holder 6 to be spaced apart from each other.

The display 10 may be installed in the air discharge device holder 6 to partition the air discharge device holder 6 to the left and right. In the air conditioner, the space between a first or left side of the display 10 and a first or left side end of the rear body 120 may be open, and the space between a second or right side of the display 10 and a second or right side end of the rear body 120 may be open. The first air discharge device 3 may be installed so that a portion thereof is positioned between the first side of the display 10 and the first side end of the rear body 120. The second air discharge device 3 may be installed so that a portion thereof is positioned between the second side of the display 10 and the second side end of the rear body 120. The pair of air discharge devices 2 and 3 may be protected by the display 10 and the air discharge device holder 6.

Each of the pair of air discharge devices 2 and 3 be shaped as a cylinder. The gap therebetween may increase in a frontward direction with respect to a middle while decreasing in a rearward direction with respect to the middle.

The display 10 may be positioned at a front portion among the front portion and a rear portion of the air discharge device holder 6. The display 10 may be positioned at a front and central side among a front and first or left side, front and central side, and front and second or right side of the air discharge device holder 6. The air discharge device holder 6 may be open at a first or left side surface, a second or right side surface, a front and first or left side, and a front and second or right side. The front and central portion of the air discharge device holder 6 may be shielded by the display 10.

Figure 7:
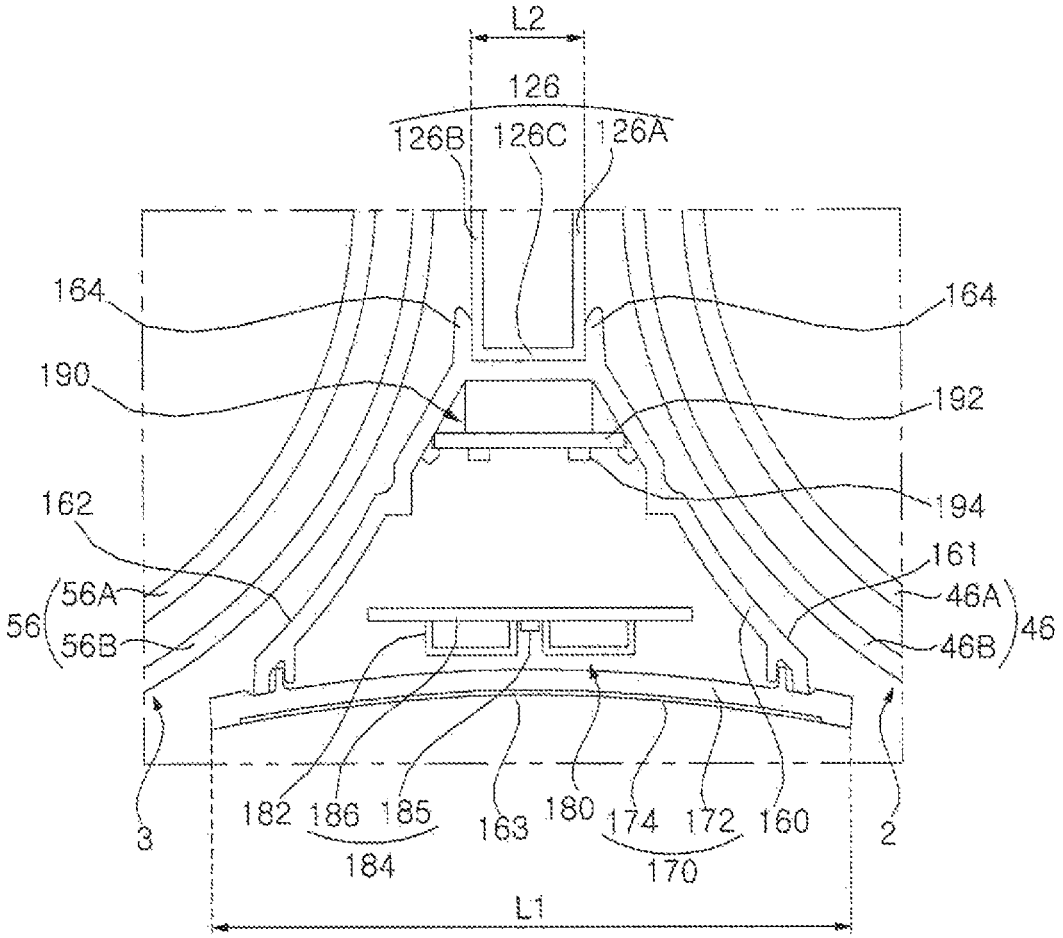
FIG. 7 is an expanded perspective view Illustrating a display of an air conditioner according to an embodiment.

FIG. 7 is an expanded perspective vie illustrating a display of an air conditioner according to an embodiment.

Figure 8:
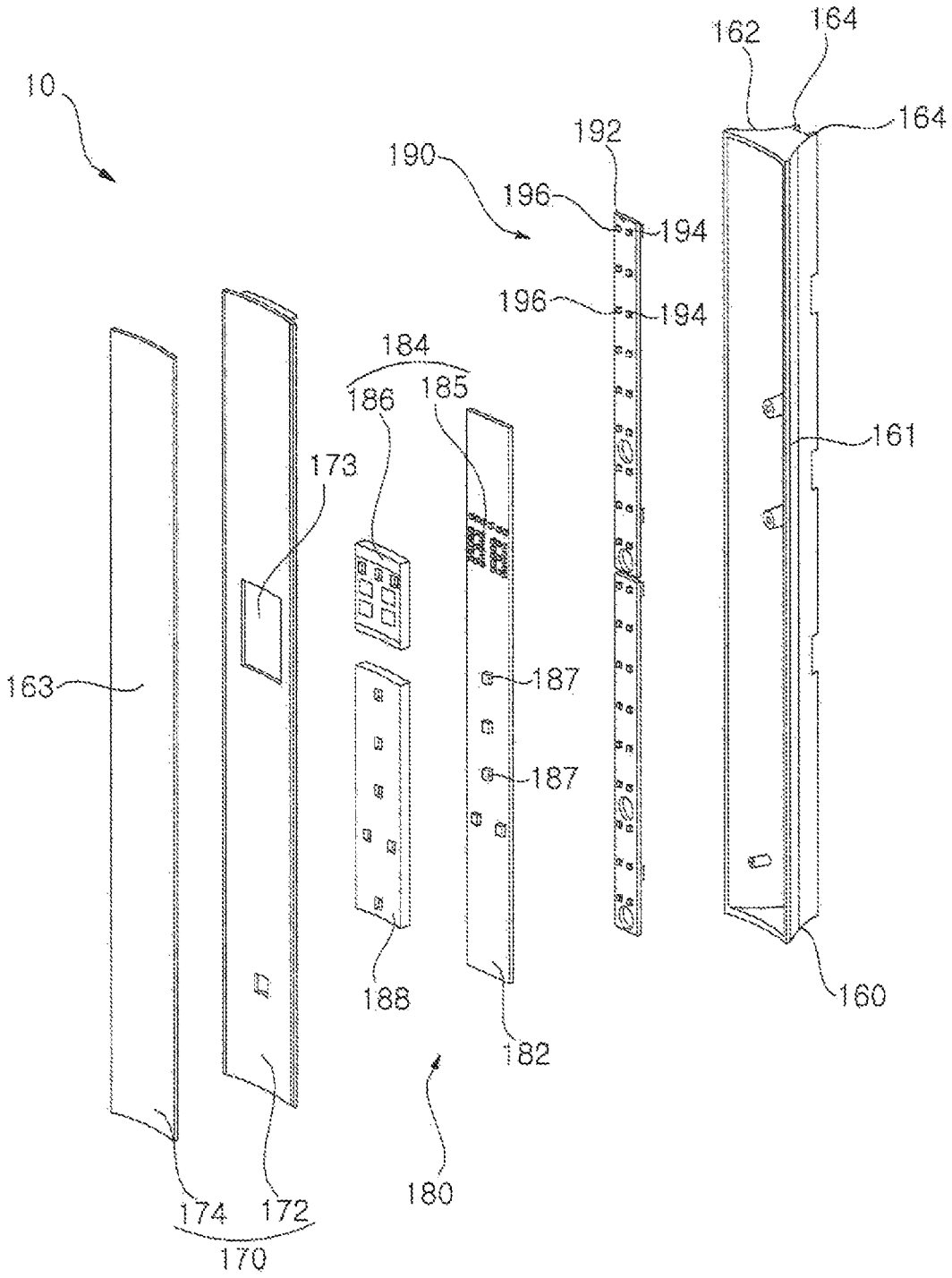
FIG. 8 is an exploded perspective view illustrating a display of an air conditioner according to an embodiment.

FIG. 8 is an exploded perspective view illustrating a display of an air conditioner according to an embodiment.

The display 10 may include a display case 160 positioned between the pair of air discharge devices 2 and 3 and with an open front surface, a display cover 170 provided at a front side of the display case 160, and a PCB 180 that radiates light to the display cover 170. The display 10 may include a rear coupler 164 coupled to the protrusion 126.

The display 10 may be formed of an assembly of a plurality of members. The display 10 may function as a control panel for manipulation of the air conditioner and as a display that displays information on the air conditioner. The display 10 may function as a display-cum-control panel.

The display 10 may be smaller in size than each of the pair of air discharge devices 2 and 3. The lateral or left-right width of the display 10 may increase in a forward direction.

First side surface 161 of the display case 160 may face the outer periphery of the first air discharge device 2, and second side surface 162 of the display 10 may face the outer periphery of the second air discharge device 3. A lateral or left-right width of the display case 160 may increase in a frontward direction.

The display case 160 may be shaped so that a rear surface thereof is closed. The first side surface 161 of the display case 160 may face the outer periphery surface of the first air discharge device 2, and the second side surface 162 may face the outer periphery surface of the second air discharge device 3. The front surface of the display case 160 may be open.

The display case 160 may be coupled to the protrusion 126. The lateral width of the display case 160 may increase in the frontward direction thereof. The rear coupler 164 may be formed in the display case 160. The rear coupler 164 may include a pair of ribs formed in the display case 160 and fitted onto the protrusion 126. The pair of ribs may each project rearwards from a rear plate of the display case 160, and a portion of the protrusion 126 may be inserted into a space between the pair of ribs and fitted into the pair of ribs.

The display case 160 may include the rear plate, a first or left side plate formed at a first or left side of the rear plate, a second or right side plate formed at a second or right side of the rear plate, a top plate formed at a top of the rear plate, and a bottom plate formed at a bottom of the rear plate. The first side plate and the second side plate may be formed so that a distance therebetween increases in a frontward direction thereof.

The display case 160 may be formed of a transparent or translucent material. The display case 160 may further include a light diffusing part or portion that may diffuse light.

The display cover 170 may be larger in size than the display case 160. The display cover 170 may cover an open front surface of the display case 160. The display cover 170 may include a front body 172 coupled to the display case 160, and a front cover 174 provided at a front surface of the front cover 172. The front body 172 may have a light transmittance hole 173, through which light from the PCB 180 may pass.

The front cover 174 may function as a display window that displays information regarding the air conditioner, and the display 10 may function as a display. The front cover 174 may operate as a touch input which a user touches to manipulate the air conditioner. The display 10 may function as a control panel.

The lateral width L1 of the display cover 170 may be larger than the lateral width L2 of the tip of the protrusion 126.

The PCB 180 may emit light to the display cover 170. The PCB 180 may include a display PCB 182 coupled to the display case 160 by, for example, a connecting member, such as a screw, and a display part or portion 184 installed on the display PCB 182.

The display portion 184 may be installed in the display PCB 182 and may include a display LED 185 that radiates light to a rear surface of the PCB cover 170. The display portion 184 may further include a light guide that guides the light radiated from the display LED 185 to the PCB cover 170. The light guide 186 may be installed in the display PCB 182 to be positioned between the display cover 170 and the display PCB 182.

The PCB 180 may include at least one touch switch 187 that switches on/off when contacted by the front cover 174. The at least one touch switch 178 may be installed in the display PCB 182 so that an end thereof comes in contact with the display cover 170.

The PCB 180 may further include a switch guide 188 that protects the at least one touch switch. The switch guide 188 may be installed in the display PCB 182 to be positioned between the display cover 170 and the display PCB 182.

The display 10 may further include an illuminating apparatus 190 that radiates light to the display case 160. The illuminating apparatus 190 may include a PCB 192 installed inside of the display case 160, at least one first or left light source 194 installed on the PCB 192 to be positioned closer to the first air discharge device 2, and at least one second or right light source 196 installed on the PCB 192 to be positioned closer to the second air discharge device 3. The at least one first light source 194 and the at least one second light source 196 may each include at least one LED.

The at least one first light source 194 may include a plurality of LEDs installed on the PCB 192 to be spaced apart from each other in a vertical direction. The at least one second light source 196 may include a plurality of LEDs installed on the PCB 192 to be spaced apart from each other in a vertical direction.

Hereinafter, an operation of embodiments configured as discussed above will be described.

First, when the air conditioner operates, the pair of air discharge device 2 and 3 may discharge air to the outside, spaced apart from each other. When the air conditioner operates, the blower 5 may be actuated so that air is suctioned in from outside of the air conditioner through the suction inlet 16 to the inside of the air conditioner and then passes through the purifying device 17 and the heat exchanger 18. After passing through the heat exchanger 18, the air may be suctioned into the blower 5 and may then be blown by the blower 5 to the pair of air discharge devices 2 and 3.

A portion of the air blown by the blower 5 may be blown to the first air discharge device 2, and the rest of the air blown by the blower 5 may be blown to the second air discharge device 3. The air may be distributed by the blower 5 into the pair of air discharge devices 2 and 3, and the distributed air may be distributively discharged into a room through the pair of air discharge devices 2 and 3.

The display 10 may display operation information on the air conditioner while shielding the gap between the pair of air discharge devices 2 and 3. Further, the display 10 may block a user from putting his or her hand or a tool through the space between the pair of air discharge devices 2 and 3 from the front of the air conditioner and may prevent any safety accident, which may occur if the user puts his or hand or a tool between the pair of air discharge devices 2 and 3.

Embodiments disclosed herein provide an air conditioner that may minimize damage to a pair of air discharge device and which may be compact.

Embodiments disclosed herein provide an air conditioner that may include a pair of air discharging units or devices; an air discharging unit holder that supports the pair of air discharging units to be spaced apart from each other; and a display assembly or display positioned between the pair of air discharging units and having a side surface that faces an outer periphery surface of one of the pair of air discharging units and another side surface that faces an outer periphery surface of the other of the pair of air discharging units. Each of the pair of air discharging units may be shaped as a cylinder, and a left-right or lateral width of the air discharging units may increase in a front direction thereof. The display assembly may be smaller in size than each of the pair of air discharging units.

The air discharging unit holder may include a top cover, the top cover including a first supporting part or support that rotatably supports an upper portion of one of the pair of air discharging units, and a second supporting part or support that rotatably supports an upper portion of the other of the pair of air discharging units. The top cover may be positioned at an upper side of the pair of air discharging units and cover a gap between the pair of air discharging units.

The air discharging unit holder may include a lower body where the pair of air discharging units may be mounted. The lower body may include a ring-shaped first seating part or seat, a ring-shaped second seating part or seat, and a lower plate part or plate that connects the first seating part with the second seating part, and may further include a first fixing ring installed or provided in the first seating part, one of the pair of air discharging units rotatably seated on the first fixing ring, and a second fixing ring installed in the second seating part the other of the pair of air discharging units rotatably seated on the second fixing ring. The display assembly may be disposed long or extend lengthwise in upper and lower directions or a vertical direction at an upper side of the lower plate part.

The air discharging unit holder may include a rear body having a protrusion that projects toward a gap between the pair of air discharging units. The air discharging unit holder may further include a top cover that covers a gap between an upper portion of the display assembly and an upper portion of the protrusion. The display assembly may have a rear coupler coupled to the protrusion.

A left-right or lateral width of a tip of the display assembly may be larger than a left-right or lateral width of a tip of the protrusion. The display assembly may include a display case positioned or provided between the pair of air discharging units and having an opened front surface; a display cover disposed or provided at a front side of the display case; and a PCB assembly or PCB that radiates light to the display cover.

The display assembly may further include an illuminating apparatus that radiates light to the display case. The illuminating apparatus may include a PCB installed inside of the display case; a first or left light source installed on the PCB to be positioned closer to one of the pair of air discharging units; and a second or right light source installed on the PCB to be positioned closer to the other of the pair of air discharging units.

Embodiments disclosed herein provide an air conditioner that may include a pair of air discharging units or devices; an air discharging unit holder that supports the pair of air discharging units to be spaced apart from each other; and a display assembly or display positioned or provided between the pair of air discharging units. The display assembly may include a display case having a side surface that faces an outer periphery surface of one of the pair of air discharging units and another side surface that faces an outer periphery surface of the other of the pair of air discharging units; a display cover disposed or provided at a front side of the display case; and a PCB assembly or PCB that radiates light to the display cover. Each of the pair of air discharging units may be shaped as a cylinder, and a left-right or lateral width of the display assembly may increase in a frontward direction thereof.

The air discharging unit holder may include a lower body where the pair of air discharging units may be mounted. The air discharging unit holder may include a rear body having a protrusion that projects toward a gap between the pair of air discharging units, and the display assembly may have a rear coupler coupled to the protrusion.

The air conditioner may further include a top cover positioned at an upper side of the pair of air discharging units and covering a gap between the pair of air discharging units.

According to embodiments disclosed herein, the pair of air discharge devices may be spaced apart from each other, thus minimizing wear or damage to the air discharge devices, which might occur when the plurality of air discharge devices come into contact with each other. The display may be positioned between the pair of air discharge devices, and thus, the air conditioner may be compact. Further, it may be possible to prevent a safety accident, which might occur if a space between the pair of air discharge devices is exposed to the outside.

Any reference in this specification to "one embodiment," "an embodiment," "example embodiment," etc., means that a particular feature, structure, or characteristic described in connection with the embodiment is included in at least one embodiment of the disclosure. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An air conditioner, comprising:

a pair of air discharge devices, wherein each of the pair of air discharge devices is shaped as a cylinder;

an air discharge device holder that supports the pair of air discharge devices to be spaced apart from each other; and a display positioned between the pair of air discharge devices and including a display case having a first side surface that faces an outer peripheral surface of a first air discharge device of the pair of air discharge devices and a second side surface that faces an outer peripheral surface of a second air discharge device of the pair of air discharge devices, wherein each of the pair of air discharge devices includes an air inlet through which air is introduced and an air outlet through which air is discharged, and each of the pair of air discharge devices is configured to be rotated on a rotational center axis of each of the pair of air discharge devices, wherein the air discharge device holder includes a rear body, wherein the rear body is spaced from the pair of air discharge devices to rotatably accommodate at least a portion of each of the pair of air discharge devices and includes a protrusion provided in a first gap between the pair of air discharge devices, wherein the display case is coupled to the protrusion of the rear body.

2. The air conditioner of claim 1, wherein a lateral width of the display increases in a forward direction thereof.

3. The air conditioner of claim 1, wherein the display is smaller in size than each of the pair of air discharge devices.

4. The air conditioner of claim 1, wherein the air discharge device holder includes a top cover, wherein the top cover includes a first support that rotatably supports an upper portion of the first air discharge device and a second support that rotatably supports an upper portion of the second air discharge device.

5. The air conditioner of claim 4, wherein the top cover is positioned at an upper side of the pair of air discharge devices and covers a gap between the pair of air discharge devices.

6. The air conditioner of claim 1, wherein the air discharge device holder includes a lower body in which the pair of air discharge devices is mounted.

7. The air conditioner of claim 6, wherein the lower body includes a ring-shaped first seat, a ring-shaped second seat, a lower plate that connects the first seat with the second seat, a first fixing ring installed in the first seat, and a second fixing ring installed in the second seat, and wherein the first air discharge device is rotatably seated on the first fixing ring and the second air discharge device is rotatably seated on the second fixing ring.

8. The air conditioner of claim 7, wherein the display extends lengthwise in a vertical direction at an upper side of the lower plate.

9. The air conditioner of claim 1, wherein the air discharge device holder further includes a top cover that covers a second gap between an upper portion of the display and an upper portion of the protrusion.

10. The air conditioner of claim 1, wherein the display includes a rear coupler coupled to the protrusion.

11. The air conditioner of claim 1, wherein a lateral width of a tip of the display is larger than a lateral width of a tip of the protrusion.

12. The air conditioner of claim 1, wherein the display case is positioned between the pair of air discharge devices and has an open front surface, and wherein the display further includes:

a display cover provided at a front side of the display case; and a first PCB that radiates light into the display cover.

13. The air conditioner of claim 12, wherein the display further includes an illuminating apparatus that radiates light into the display case.

14. The air conditioner of claim 13, wherein the illuminating apparatus includes:

a second PCB installed inside of the display case;

at least one first light source installed on the second PCB and positioned closer to the first air discharge device; and at least one second light source installed on the PCB and positioned closer to the second air discharge device.

* * * * *